US010066402B2

(12) United States Patent
Andrews et al.

(10) Patent No.: US 10,066,402 B2
(45) Date of Patent: Sep. 4, 2018

(54) MASONRY TROWEL

(71) Applicants: Clinton R. Andrews, Grosse Pointe Park, MI (US); Mark W. Andrews, Grosse Pointe Park, MI (US)

(72) Inventors: Clinton R. Andrews, Grosse Pointe Park, MI (US); Mark W. Andrews, Grosse Pointe Park, MI (US)

( * ) Notice: Subject to any disclaimer, the term of this patent is extended or adjusted under 35 U.S.C. 154(b) by 482 days.

(21) Appl. No.: 14/295,595

(22) Filed: Jun. 4, 2014

(65) Prior Publication Data

US 2015/0354236 A1 Dec. 10, 2015

(51) Int. Cl.
*E04F 21/16* (2006.01)
*E04F 21/165* (2006.01)
*E04G 21/20* (2006.01)

(52) U.S. Cl.
CPC ..... *E04F 21/165* (2013.01); *E04F 21/1652* (2013.01); *E04G 21/201* (2013.01)

(58) Field of Classification Search
CPC ..... E04F 21/1655; E04F 21/161; E04F 21/21; E04F 21/1652; E04G 21/201
USPC ..... 15/235.7, 235.3, 235.4
See application file for complete search history.

(56) References Cited

U.S. PATENT DOCUMENTS 762,307 A * 6/1904 Hawksworth ..... E04F 21/06 15/235.4
1,321,532 A 11/1919 Mann
5,446,941 A 9/1995 Kelsay
6,880,198 B1 * 4/2005 Hazard ..... E04F 21/165 15/235.4
7,818,844 B2 * 10/2010 Wolan ..... E04G 21/20 15/235.4

(Continued)

FOREIGN PATENT DOCUMENTS

DE 916854 C 8/1954
DE 8526355 U1 11/1985
DE 3443941 A1 6/1986

(Continued)

OTHER PUBLICATIONS

International Search Report dated Feb. 6, 2015.
Angle Trowel, "SE & FA Technic Ltd. Co.—Gypsum Plaster Tools" http://www.sefateknik.com/en/gypsum-plaster-tools.

*Primary Examiner* — Christopher M Koehler
*Assistant Examiner* — Stephanie Berry
(74) *Attorney, Agent, or Firm* — Dickinson Wright PLLC

(57) ABSTRACT

The masonry trowel (20) comprises a plate (22) extending in a plane (ρ) including an open surface (26) and a holding surface (24) having a pair of front perimeters (30) converging toward one another from a pair of shoulders (28) to define a V shape (30-30) and a point (32) in the plate (22). A handle (38) extends along a gripping axis (A) connected to the open surface (26) by a shank (44). A pair of walls (46) extend from and along the V shape (30-30) to an upper rim (48) to present an outlet (50) defined by each of the walls (46) having a front edge (52) slanting upward from the holding surface (24) and along each of the walls (46) at an egress angle (α) to a junction (54) with the upper rim (48). Each of the walls (46) is tilted at an included angle (θ) to space the junctions (54) and the front edges (52) at a constant width (w) along the outlet (50). In an engaged position, the trowel is at a slope angle (φ) to engage the front edges (52) with the vertical joint between bricks.

8 Claims, 5 Drawing Sheets

(56) References Cited

U.S. PATENT DOCUMENTS 7,972,074 B2 * 7/2011 Lepage ..... E04F 21/165
15/235.7

FOREIGN PATENT DOCUMENTS

| | | | |
|---|---|---|---|
| GB | 2035432 | A | 6/1980 |
| GB | 2275959 | A | 9/1994 |
| GB | 2299124 | A | 9/1996 |
| NL | 1009848 | C1 | 2/2000 |

* cited by examiner

MASONRY TROWEL

BACKGROUND OF THE INVENTION

1. Field of the Invention

A masonry trowel for applying mortar in a vertical joint between at least two bricks adjacent one another in a row with the vertical joint disposed centrally above a lower brick.

2. Description of the Prior Art

Masonry trowels provide an adequate platform for supporting mortar so that it can be applied to the horizontal joints between bricks. Such a masonry trowel is disclosed in U.S. Pat. No. 1,321,532, issued on Nov. 11, 1919, in the name of O. F. Mann. This trowel includes a plate that extends in a plane and has a holding surface and an open surface being parallel and spaced from one another with a maximum span slightly less than the width of a common brick. The plate defines a pair of front perimeters that extend in a forward direction from a rear end member in parallel fashion to a point in the plate. Other masonry trowels include shoulders at the maximum span of the plate to define a V shape with a point in the plate, as illustrated in U.S. Pat. No. 6,880,198, issued Apr. 19, 2005 to David F. Hazard. A handle of cylindrical shape frequently extends along a gripping axis between a distal end and a support end which is connected to the plate at the rear end member with the gripping axis disposed at a grip angle relative to the plane. A pair of walls extend transversely from the holding surface of the plate and along the parallel perimeters of the plate to an upper rim to define an outlet.

SUMMARY OF THE INVENTION

The invention provides such a masonry trowel characterized by an outlet defined by each of the walls having a front edge slanting transversely from the holding surface of the plate and along each of the walls at an egress angle less than ninety degrees (90°) relative to the plane to a respective junction with the upper rim whereby the mortar may be channeled along the holding surface and through the outlet and into the vertical joint between the bricks as the point rests upon the lower brick in an engaged position with the holding surface on a downward slant at a slope angle equaling ninety degrees (90°) minus the egress angle relative to horizontal to engage the front edges with the vertical joint between the bricks.

Advantages of the Invention

The masonry trowel is designed specifically to improve the productivity and efficiency of applying mortar in a vertical joint between bricks. The walls allow applying mortar to the entire vertical joint with one stroke of a narrow guide or pointing trowel. The front edge of each of the walls slants upward at an egress angle so that the front edge can be held flush against the brick in an engaged position. This engaged position imparts a downward slant to the plate at a slope angle which aids the gravitational flow of mortar toward the vertical joint between the bricks. The point of the plate extends past the walls and rests upon a lower brick in the engaged position to aid in supporting the masonry trowel while the mortar is being applied in the vertical joint between the bricks by the pointing trowel.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
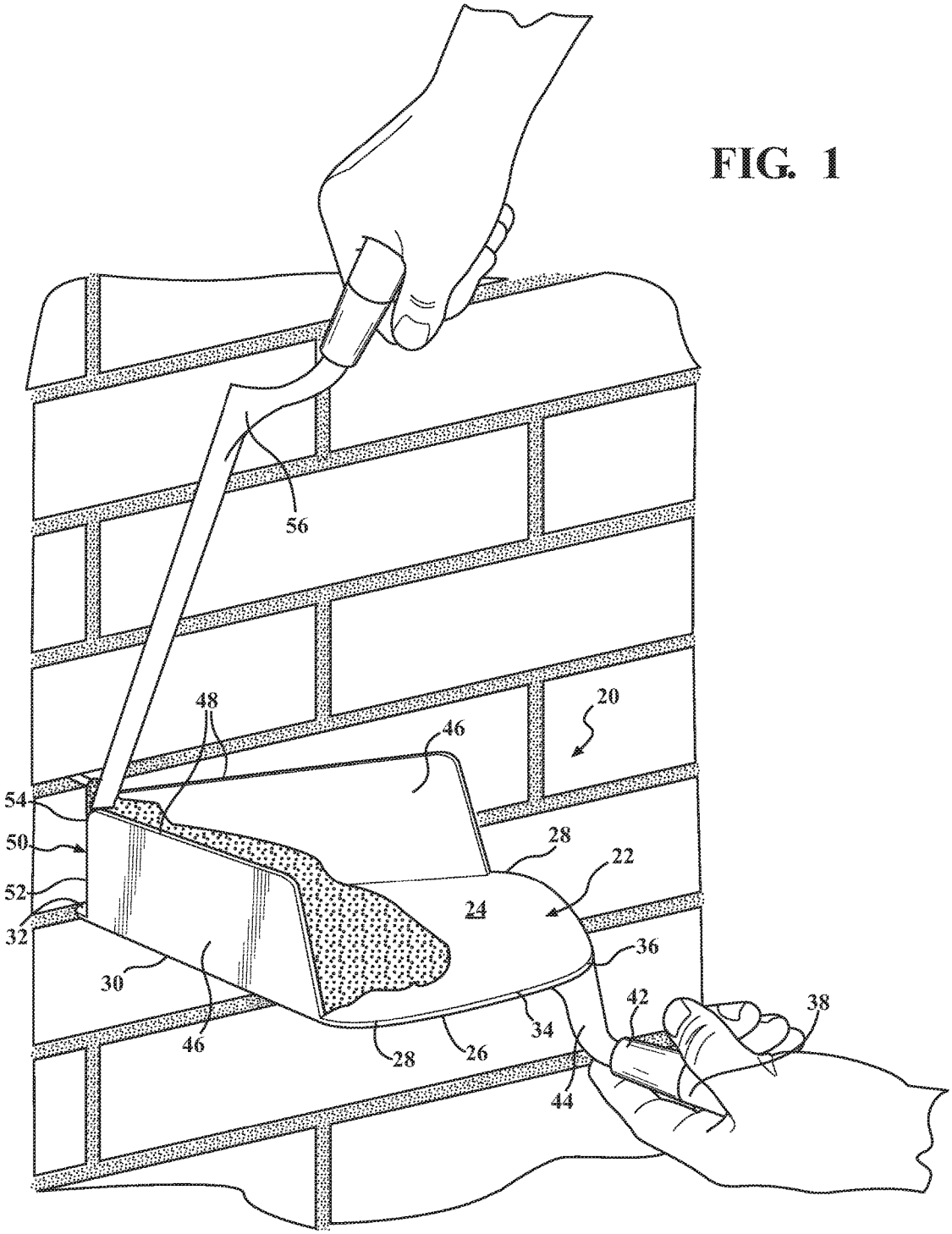
FIG. 1 is a perspective view of the enabling embodiment as used to apply mortar in the vertical joint between bricks.
Figure 2:
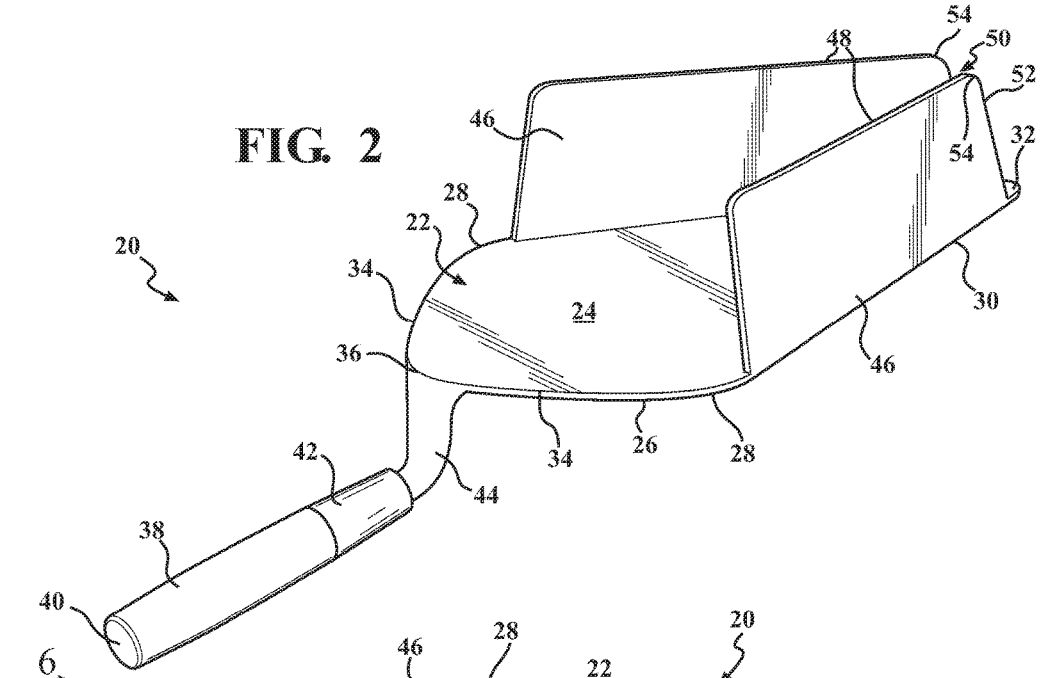
FIG. 2 is a perspective view of the enabling embodiment.
Figure 3:
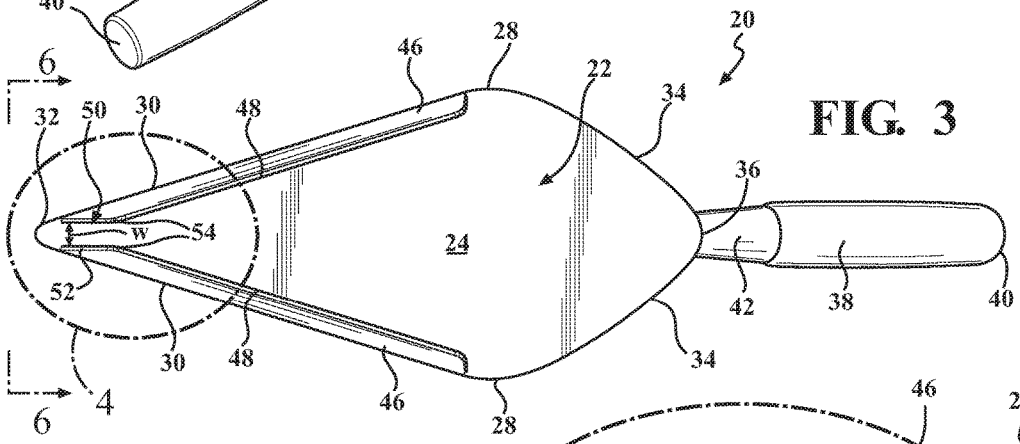
FIG. 3 is a top view of the enabling embodiment.

Referring to the Figures, wherein like numerals indicate corresponding parts throughout the several views, a masonry trowel 20 is generally shown for applying mortar in a vertical joint between at least two bricks that are adjacent one another in a row with the vertical joint disposed centrally above a lower brick.

The masonry trowel 20 comprises a plate 22, as generally indicated, extending in a plane ρ. The plate 22 has a holding surface 24 and an open surface 26 that are parallel and spaced from one another at a thin thickness t of less than one-eighth of an inch. The holding surface 24 of the plate 22 defines a pair of shoulders 28 at a maximum span, preferably four and one-quarter inches, and a pair of front perimeters 30 that converge toward one another in a forward direction between thirty to forty degrees (30°-40°), preferably thirty-five degrees (35°), from the shoulders 28 of the plate 22 to define a V shape 30-30, thereby defining a point 32 in the plate 22. The holding surface 24 further defines a pair of rear perimeters 34 that converge toward one another in a rearward direction from the shoulders 28 in a generally C-shape to an apex 36. In other words, the rear perimeters 34 converge in such a rearward direction from the shoulders 28 to the apex 36 of the plate 22 that is opposite the forward direction of the front perimeters 30 (i.e., away from the point 32 of the plate 22). The point 32 of the plate 22 is spaced farther from the shoulders 28 of the plate 22 than the apex 36 of the plate 22 is spaced from the shoulders 28. In the enabling embodiment, the point 32 and the apex 36 of the plate 22 are spaced ten inches from one another (i.e., the plate 22 of the masonry trowel 20 is ten inches long). The shoulders 28, apex 36, and point 32 of the plate 22 are rounded.

A handle 38 of cylindrical shape extends along a gripping axis A between a distal end 40 and a support end 42. The support end 42 of the handle 38 is connected to the open surface 26 of the plate 22 with the gripping axis (A) disposed at an acute grip angle (β) relative to said plane ρ. A shank 44 connects the support end 42 of the handle 38 to the apex 36 of the plate 22 on the open surface 26 of the plate 22 for supporting the plate 22 in the plane ρ at the acute grip angle β relative to the gripping axis A.

Figure 4:
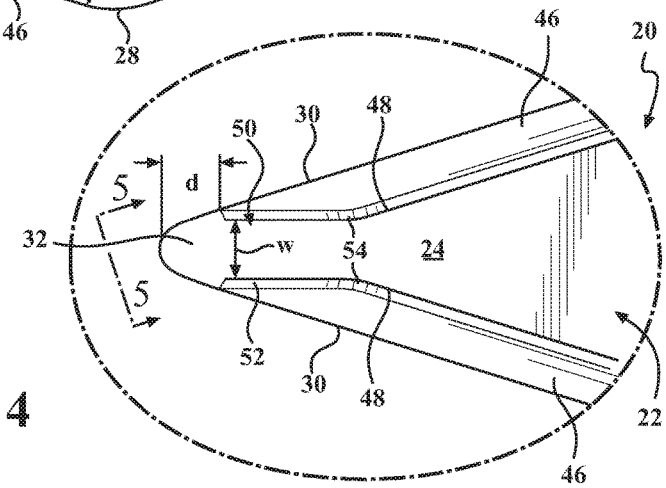
FIG. 4 is an enlarged top view taken within the circle labeled 4 of FIG. 3.
Figure 7:
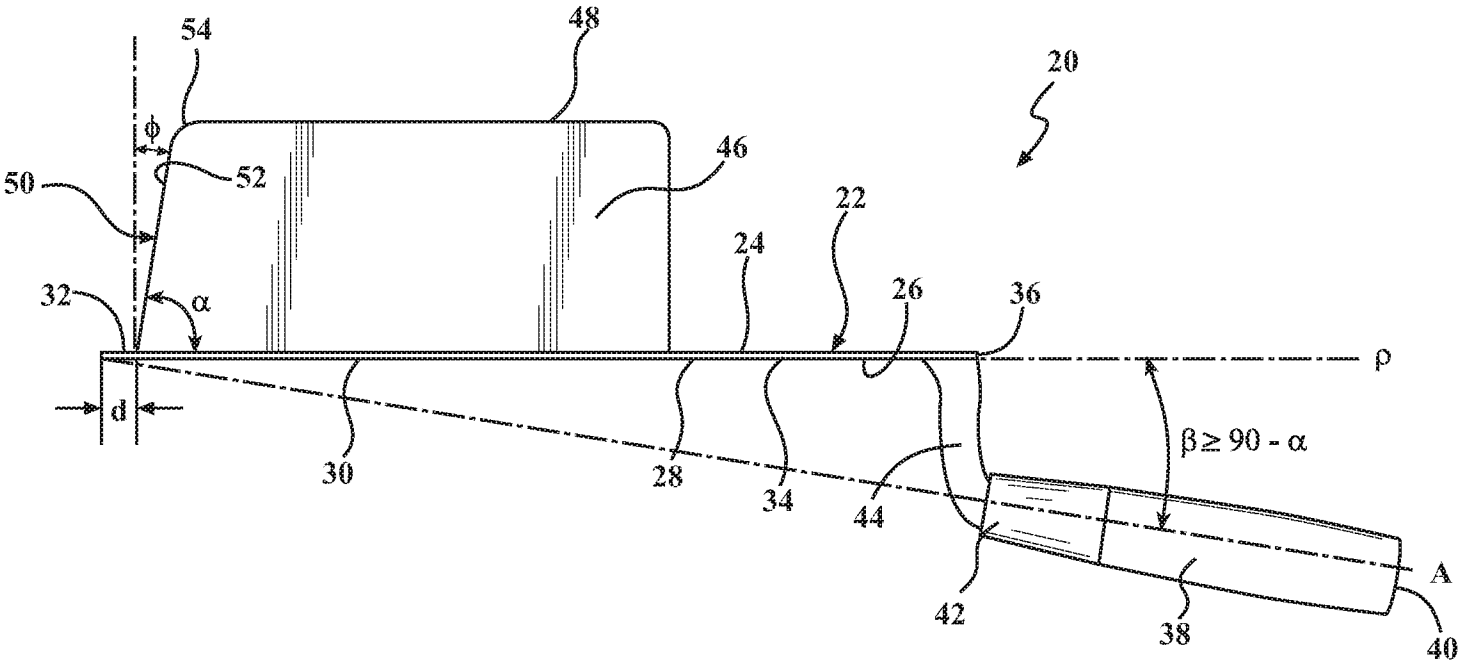
FIG. 7 is a side view of the preferred embodiment in a horizontal plane.

A pair of walls 46 extend transversely from the holding surface 24 of the plate 22 and along the V shape 30-30 of the front perimeters 30 of the plate 22 to an upper rim 48 to define an outlet 50, as generally indicated. In other words, transversely is herein intended to include less than ninety degrees (90°). In the enabling embodiment, the height of each of the walls 46 equals, but is not limited to, the height of a common brick. As best shown in FIGS. 4 and 7, the outlet 50 is spaced an inward distance d on the holding surface 24 from the point 32 of the plate 22. The upper rim 48 of each of the walls 46 extends along and parallel to each of the respective front perimeters 30 of the plate 22.

Figure 5:
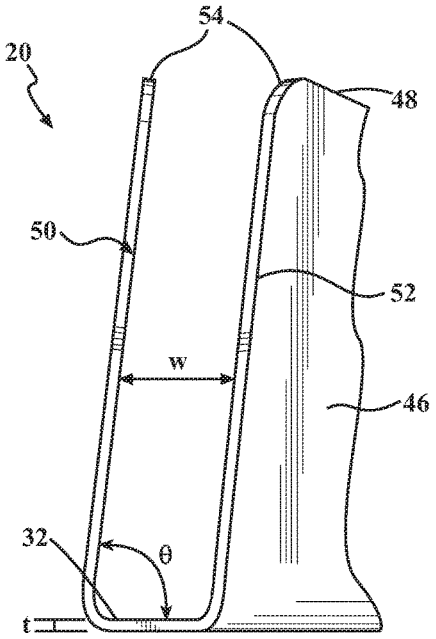
FIG. 5 is a view taken along line 5-5 of FIG. 4.
Figure 6:
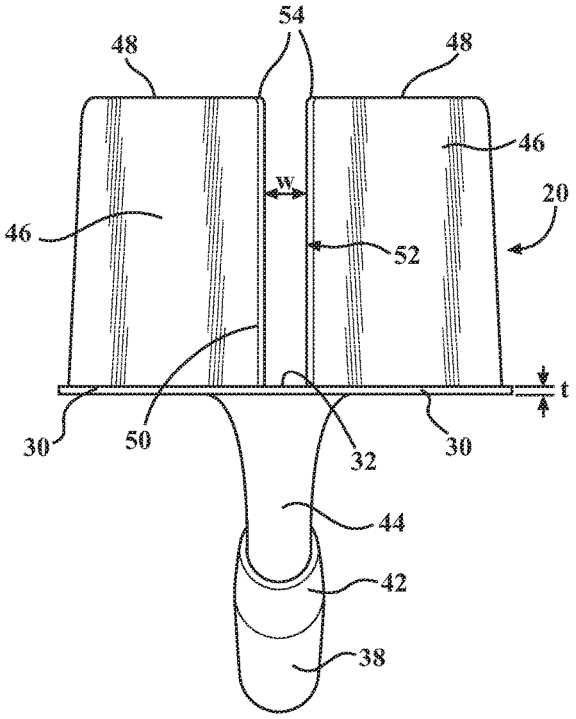
FIG. 6 is a front view taken along line 6-6 of FIG. 3.

The masonry trowel 20 is characterized by the outlet 50 being defined by each of the walls 46 having a front edge 52 that slants upward from the holding surface 24 of the plate 22 and along the wall at an egress angle α less than ninety degrees (90°) relative to the plane p, as best shown in FIG. 7, to a respective junction 54 with the upper rim 48. The masonry trowel 20 is further characterized by each of the walls 46 being tilted at an included angle θ less than ninety degrees (90°) relative to the plane ρ, as best shown in FIG. 5, to slant each of the walls 46 inward toward one another and thereby space the junctions 54 and the front edges 52 of the outlet 50 at a constant width w along the outlet 50 extending rearward between the holding surface 24 of the plate 22 and the junctions 54, as best shown in FIG. 4. In other words, the constant width w of the outlet 50 allows a user to apply the mortar to the entire vertical joint between the bricks with one stroke of a pointing trowel 56 or narrow guide. In the enabling embodiment, the constant width w of the outlet 50 equals, but is not limited to, one-half of an inch.

As best shown in FIG. 7, the acute grip angle β of the handle 38 is no less than ninety degrees (90°) minus the egress angle α of the front edges 52 to prevent the gripping axis A of the handle 38 from being disposed above horizontal when the plane ρ is in the engaged position. Lastly, each of the walls 46 extend from a location spaced from the shoulders 28 of the plate 22 to the junctions 54 with the front edges 52 of the outlet 50.

Figure 8:
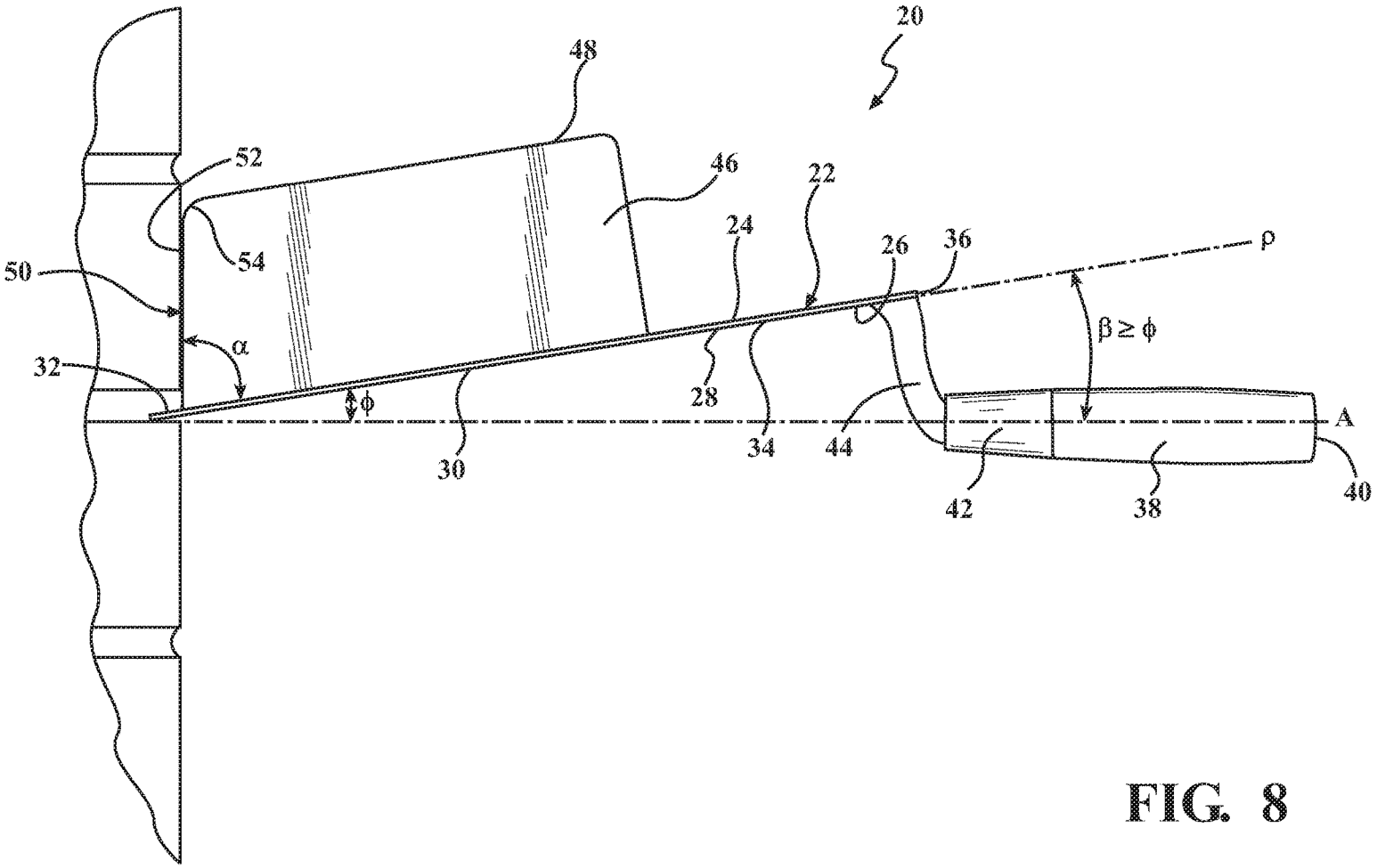
FIG. 8 is a side view similar to FIG. 7, but in the engaged position with the front edges of each of the walls engaging a brick-wall.

The mortar may be channeled along the holding surface 24 and through the outlet 50 and into the vertical joint between the bricks using the pointing trowel 56, as best shown in FIG. 1, as the point 32 of the plate 22 rests upon the lower brick in an engaged position (FIGS. 1 and 8) with the holding surface 24 on a downward slant at a slope angle φ equaling ninety degrees (90°) minus the egress angle α relative to horizontal, as best shown in FIG. 8, to engage the front edges 52 with the vertical joint between the bricks. In other words, when in the engaged position, the slope angle φ of the holding surface 24 provides a downward slant to the holding surface 24, thereby aiding in gravitational flow of the mortar through the outlet 50 and into the vertical joint between the bricks. Additionally, the point 32 of the plate 22 extends past each of the walls 46 and rests upon the lower brick in the engaged position with the front edges 52 of the walls 46 engaging the vertical joint between bricks to aid in supporting the masonry trowel 20 while the mortar is being applied into the vertical joint between the bricks.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

ELEMENT LIST

| Element Symbol | Element Name |
|---|---|
| A | gripping axis |
| d | inward distance |
| t | thin thickness |
| w | constant width |
| 20 | masonry trowel |
| 22 | plate |
| 24 | holding surface |
| 26 | open surface |
| 28 | shoulders |
| 30 | front perimeters |
| 32 | point |
| 34 | rear perimeters |
| 36 | apex |
| 38 | handle |
| 40 | distal end |
| 42 | support end |
| 44 | shank |
| 46 | pair of walls |
| 48 | upper rim |
| 50 | outlet |
| 52 | front edge |
| 54 | junction |
| 56 | pointing trowel |
| φ | slope angle |
| ρ | plane |
| β | acute grip angle |
| α | egress angle |
| θ | included angle |

What is claimed is:

1. A masonry trowel (20) for applying mortar in a vertical joint between at least two bricks adjacent one another in a row with the vertical joint disposed centrally above a lower brick, said masonry trowel (20) comprising;

a plate (22) extending in a plane (ρ) and having a holding surface (24) and an open surface (26) being parallel and spaced from one another at a thin thickness (t) defining a pair of shoulders (28) at a maximum span and a pair of front perimeters (30) converging toward one another in a forward direction from said shoulders (28) of said plate (22) to define a V shape (30-30) with a point (32) in said plate (22), a handle (38) of cylindrical shape extending along a gripping axis (A) between a distal end (40) and a support end (42) connected to said open surface (26) of said plate (22) with said gripping axis (A) disposed at an acute grip angle (β) relative to said plane (ρ), a pair of walls (46) extending transversely from said holding surface (24) of said plate (22) and along said V shape (30-30) of said front perimeters (30) of said plate (22) to an upper rim (48) and defining an outlet (50), and characterized by, said walls (46) being slanted inward toward one another by each of said walls (46) being tilted inward at an included angle (θ) less than ninety degrees (90°) relative to said plane (ρ), said outlet (50) defined by each of said walls (46) having a front edge (52) slanting transversely from said holding surface (24) of said plate (22) each at an inward distance (d) on said holding surface (24) from said point (32) of said plate (22) and slanted rearward at an egress angle (α) less than ninety degrees (90°) relative to said plane (ρ) to a respective junction (54) with said upper rim (48) and with each of said walls (46) extending from said front edges (52) along each of said perimeters of said V shape (30-30) of said plate (22) and with said front edges (52) being parallel and spaced at a constant width (w) along said outlet (50) extending rearward between said holding surface (24) and said junctions (54) whereby the mortar may be channeled along said holding surface (24) and through said outlet (50) and into the vertical joint between the bricks as said point (32) rests upon the lower brick in an engaged position with said holding surface (24) on a downward slant at a slope angle (φ) equaling ninety degrees (90°) minus said egress angle (α) relative to horizontal to engage said front edges (52) with the vertical joint between the bricks, and said acute grip angle (β) of said handle (38) being no less than ninety degrees (90°) minus said egress angle (α) of said front edges (52) to prevent said gripping axis (A) of said handle (38) from being disposed above horizontal when said plane (ρ) is in said engaged position.

2. A masonry trowel (20) as set forth in claim 1 wherein each of said walls (46) extend along said perimeters of said V shape (30-30) from a location between said shoulders (28) of said plate (22) and said front edges (52) of said outlet (50).

3. A masonry trowel (20) as set forth in claim 1 including a shank (44) connecting said support end (42) of said handle (38) to said apex (36) of said plate (22) on said open surface (26) of said plate (22) for supporting said plate (22) in said plane (ρ) at said acute grip angle (β) relative to said gripping axis (A).

4. A masonry trowel (20) as set forth in claim 1 wherein said thin thickness (t) being is less than one-eighth of an inch.

5. A masonry trowel (20) as set forth in claim 1 including said shoulders (28) of said plate (22) being rounded.

6. A masonry trowel (20) as set forth in claim 1 wherein said plate (22) defines a pair of rear perimeters (34) converging toward one another in a rearward direction from said shoulders (28) of said plate (22) in a generally C-shape to an apex (36).

7. A masonry trowel (20) as set forth in claim 6 including said point (32) of said plate (22) being spaced farther from said shoulders (28) of said plate (22) than said apex (36) of said plate (22) being spaced from said shoulders (28).

8. A masonry trowel (20) for applying mortar in a vertical joint between at least two bricks adjacent one another in a row with the vertical joint disposed centrally above a lower brick, said masonry trowel (20) comprising;

a plate (22) extending in a plane (ρ) and having a holding surface (24) and an open surface (26) being parallel and spaced from one another at a thin thickness (t) defining a pair of shoulders (28) at a maximum span and a pair of front perimeters (30) converging toward one another in a forward direction from said shoulders (28) of said plate (22) to define a V shape (30-30) with a point (32) in said plate (22), a handle (38) of cylindrical shape extending along a gripping axis (A) between a distal end (40) and a support end (42) connected to said open surface (26) of said plate (22) with said gripping axis (A) disposed at an acute grip angle (ρ) relative to said plane (ρ), a pair of walls (46) extending transversely from said holding surface (24) of said plate (22) and along said V shape (30-30) of said front perimeters (30) of said plate (22) to an upper rim (48) and defining an outlet (50), and characterized by, said outlet (50) defined by each of said walls (46) being slanted inward toward one another by each of said walls (46) being tilted inward at an included angle (θ) less than ninety degrees (90°) relative to said plane (ρ) with each wall (46) presenting a front edge (52) slanting rearward and transversely from said holding surface (24) of said plate (22) at an egress angle (α) less than ninety degrees (90°) relative to said plane (ρ) to a respective junction (54) with said upper rim (48) with said front edges (52) of said outlet (50) being parallel and spaced at a constant width (w) along said outlet (50) extending rearward between said holding surface (24) of said plate (22) and said junctions (54) and with each of said walls (46) extending along each perimeter of said V shape (30-30) of said plate (22) whereby the mortar may be channeled along said holding surface (24) and through said outlet (50) and into the vertical joint between the bricks as said point (32) rests upon the lower brick in an engaged position with said holding surface (24) on a downward slant at a slope angle (φ) equaling ninety degrees (90°) minus said egress angle (α) relative to horizontal to engage said front edges (52) with the vertical joint between the bricks, and said acute grip angle (β) of said handle (38) being no less than ninety degrees (90°) minus said egress angle (α) of said front edges (52) to prevent said gripping axis (A) of said handle (38) from being disposed above horizontal when said front edges (52) are in said engaged position.

* * * * *